US006440199B2

(12) United States Patent
Tolvanen

(10) Patent No.: US 6,440,199 B2
(45) Date of Patent: Aug. 27, 2002

(54) ELECTRIC FILTER

(75) Inventor: Juha Kristiad Tolvanen, Vantaa (FI)

(73) Assignee: Alstom (Switzerland) Ltd., Baden (CH)

( * ) Notice: Subject to any disclaimer, the term of this patent is extended or adjusted under 35 U.S.C. 154(b) by 0 days.

(21) Appl. No.: 09/931,579

(22) Filed: Aug. 16, 2001

Related U.S. Application Data

(63) Continuation of application No. PCT/FI00/00160, filed on Mar. 1, 2000.

(30) Foreign Application Priority Data

Mar. 2, 1999 (FI) ..... 990447

(51) Int. Cl.[7] ..... B03C 3/155; B03C 3/82
(52) U.S. Cl. ..... 96/15; 96/55; 96/84; 96/92
(58) Field of Search ..... 96/86, 87, 15, 96/26, 84, 92, 75–79, 55, 57–59; 52/192, 197

(56) References Cited

U.S. PATENT DOCUMENTS

| | | | | | |
|---|---|---|---|---|---|
| 1,584,055 | A | * | 5/1926 | Weiskopf | 96/92 |
| 1,846,169 | A | * | 12/1932 | Weiskopf | 96/84 |
| 2,249,801 | A | * | 7/1941 | White | 96/75 X |
| 2,488,712 | A | * | 11/1949 | Dahlman | 96/86 |
| 2,528,842 | A | * | 11/1950 | Penney | 96/86 |
| 3,006,066 | A | * | 10/1961 | Grossen et al. | 96/87 X |
| 3,173,774 | A | * | 3/1965 | Getzin | 96/86 |
| 3,175,341 | A | * | 3/1965 | Winter | 96/86 |
| 3,484,800 | A | * | 12/1969 | Lange et al. | 96/92 |
| 4,325,714 | A | * | 4/1982 | Wooldridge | 96/86 |
| 4,726,814 | A | * | 2/1988 | Weitman | 96/77 X |
| 5,248,324 | A | * | 9/1993 | Hara | 96/84 X |
| 5,282,891 | A | * | 2/1994 | Durham | 96/75 |

FOREIGN PATENT DOCUMENTS

| | | |
|---|---|---|
| DE | 816691 | 10/1951 |
| DE | 1241806 | 6/1967 |
| SE | 223939 | 12/1968 |

* cited by examiner

*Primary Examiner*—Richard L. Chiesa
(74) *Attorney, Agent, or Firm*—Ladas & Parry

(57) ABSTRACT

The invention relates to an electric filter which includes emission and separation systems, which are intended for separating particles from a gaseous, particle-containing medium passing through the electric filter, and a filter chamber (1) which surrounds the emission and separation systems and their peripheral devices, the filter chamber (1) having a top surface (2), a base structure (3), and a wall structure (4) provided with thermal insulation and sheet metal cladding. The base structure (3) is made of concrete or the like and includes at least one trough or hopper bottomed tank (5) for the separated particales, wall structure (4) is made of steel and attached to the base structure (3) with a substantially rigid joint (5). The wall structure (4), except for the rigid joint (6), is provided to allow thermal expansion and contraction.

10 Claims, 4 Drawing Sheets

ELECTRIC FILTER

This application is a continuation of copending International Application PCT/FI00/00160 filed on Mar. 1, 2000 and which designated the U.S., and was published in English, claims the benefit thereof and incorporates the same by reference.

BACKGROUND OF THE INVENTION

The invention relates to an electric filter which comprises emission and separation systems, which are intended for separating particles from a gaseous, particle-containing medium which passes through the filter, and a filter chamber which surrounds the emission and separation systems and their peripheral devices, the filter chamber comprising a top structure, a bottom structure and a wall structure provided with thermal insulation and sheet metal cladding.

The emission system of the electric filter consists of negatively charged emission electrodes and separation electrodes or earth plates which are in the zero position (i.e. the separation system functions as the positive pole). The gas to be purified is led through the electric filter and it passes between positively and negatively charged electrodes. Since there is usually a voltage of about 100 kV between the positively and the negatively charged electrodes, the voltage generates corona discharges between the electrodes. When the particles mixed with gas pass through a corona discharge, the corona discharge charges the particles mainly negatively and makes them attach to positively charged plates. On the other hand, positive particles attach to emission electrodes. Shaking devices keep both systems clean and impurities fall to the bottom of the electric filter.

Various applications of electric filters are used e.g. in power plants, pulp mills and in different metallurgic processes where the purpose of the electric filter is to separate particles from hot flue gas led through it. In such operational environments the temperature of the flue gas is usually about 150 to 200° C. and the pressure in the electric filter may be about ±5000 Pa, for example.

Since the electric filter is usually rather a large device, a lot of material is needed for constructing it. For this reason, the filter chambers of electric filters are conventionally made of ordinary structural steel (e.g. Fe 37B).

The problem related to filter chambers of electric filters made of structural steel is corrosion. The flue gases contain e.g. sulphur (S) and lye (NaOH) which, as is well-known, cause corrosion.

The above-mentioned corrosive substances do not, however, cause corrosion as long as the temperature is high enough. When the temperature drops below the dew point of corrosion, which often happens in the lower part of the filter chamber in the electric filter where the temperature is much lower than in the upper part of the filter chamber, these substances cause corrosion. The temperature in the upper sections of the filter chamber in the electric filter may be the same as that of the gas led through the electric filter, e.g. +180° C., whereas the temperature in the lower part of the filter chamber in the electric filter may be close to the acid dew point.

Particles separated from the flue gas fall to the lower part of the filter chamber in the electric filter, where the temperature is close to the above-mentioned corrosion dew point, i.e. the proportion of corrosive substances is higher in the lower part.

This problem could be solved by making the whole filter chamber of the electric filter of acid-resistant steel, but this would be a very expensive solution.

A much cheaper solution is to make the bottom structure of the filter chamber of the electric filter of concrete and the wall structure of the filter chamber of ordinary structural steel.

Such a solution, however, causes another kind of problem. The wall thickness of the concrete base structure of the filter chamber in the electric filter is in the range of 300 to 400 mm, whereas the thickness of the wall made of steel is about 5 mm. As is generally known, steel and concrete have the same coefficient of thermal expansion ($11\times10^{-6}K^{-1}$), but as the mass of the wall structure made of steel is much smaller than that of the bottom structure made of concrete, the wall structure made of steel heats up much quicker than the bottom structure made of concrete. As a result of this, the thermal expansion of the wall structure made of steel occurs much quicker than that of the concrete base. For example, when the electric filter is started, its temperature may be same as the outside temperature. After the start-up, flue gas the temperature of which is 140 to 200° C., e.g. +180° C., is led through the electric filter. This quickly causes a temperature difference of 100° C. or more between the wall structure of the filter chamber in the electric filter and the base structure of the filter chamber. Correspondingly, the wall structure made of steel contracts much quicker than the base structure made of concrete during the shut-down.

Thermal expansion and contraction cause tension in the joint between the concrete base and the steel wall structure, which may break the joint. For example, the length of a 15-meter long steel wall structure may increase 15 to 30 mm when the temperature rises to 140 to 200° C. in the electric filter, whereas the length of the concrete base structure hardly increases at all.

BRIEF DESCRIPTION OF THE INVENTION

The object of the invention is to provide an electric filter which eliminates the above-mentioned problems.

The objects of the invention are achieved with an electric filter which is characterized in that the base structure is made of concrete and comprises at least one trough or hopper bottomed tank for separated particles, in that the wall structure is made of steel and attached to the base structure with a substantially rigid joint, and in that the wall structure, except for the rigid joint, is provided to allow thermal expansion and contraction.

The preferred embodiments of the electric filter according to the invention are disclosed in the dependent claims.

The invention is based on the idea that a rigid joint is provided between the concrete base structure and the steel wall structure. Here the rigid joint means that the joint is such that it prevents the steel wall structure from moving with respect to the concrete base structure at the joint. On the other hand, the steel wall structure, except for the rigid joint, is provided to allow thermal expansion and contraction.

The wall structure preferably allows to direct the thermal expansion and contraction of the wall structure in the desired direction.

An advantage of the electric filter according to the invention is that it can be made of a cheap material, i.e. of concrete and structural steel.

BRIEF DESCRIPTION OF THE DRAWINGS

The invention will be described in greater detail by means of preferred embodiments with reference to the accompanying drawings, in which.

DETAILED DESCRIPTION OF THE INVENTION

Figure 1:
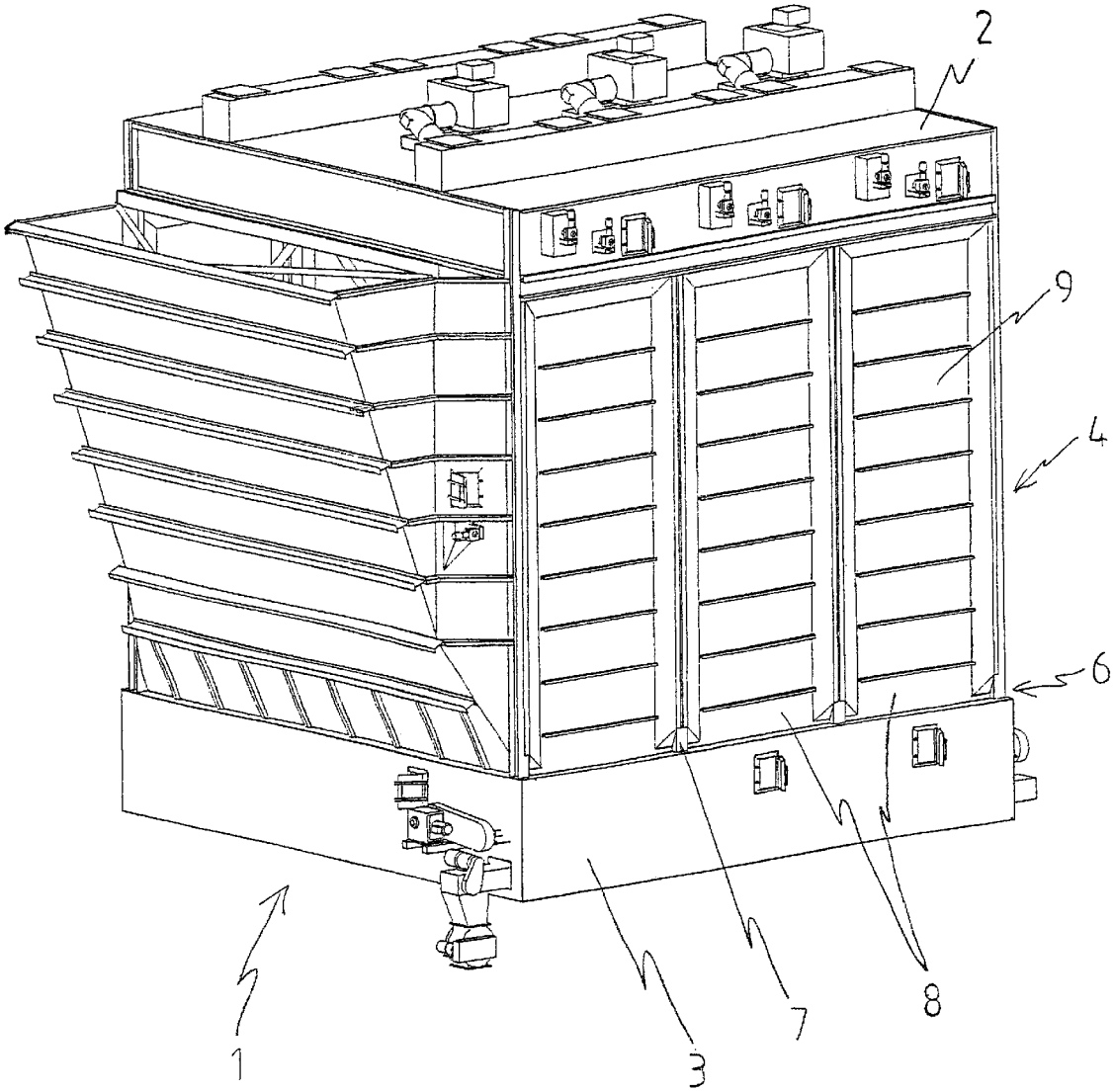
FIG. 1 is a simplified view of the electric filter without thermal insulation and sheet metal cladding.

FIG. 1 is a simplified view of the electric filter according to the invention without thermal insulation. The electric filter comprises emission and separation systems (not shown) the purpose of which is to separate particles from a gaseous, particle-containing medium which passes through the filter. The operating principle of the electric filter is known per se and will not be explained in greater detail in this context.

The electric filter comprises a filter chamber 1 which surrounds the separation and emission systems and their peripheral devices (not shown).

The filter chamber 1 comprises a top structure 2, a base structure 3 and a wall structure 4. The wall structure 4 is provided with thermal insulation (not shown) outside the wall structure 4 and with sheet metal cladding (not shown) covering it. The insulation may be e.g. a mineral wool layer with a thickness of 200 to 300 mm.

The base structure 3 of the filter chamber 1 in the electric filter according to the invention is made of concrete and provided with at least one trough or hopper bottomed tank 5 for separated particles. Since the particles fall to the trough or hopper bottomed tank 5 made of concrete, they do not cause corrosion.

The wall structure 4 of the filter chamber 1 in the electric filter according to the invention is made of structural steel and connected to the base structure 3 with a substantially rigid joint 6. Here the rigid joint 6 means that the wall structure 4 is attached to the base structure 3 so that the wall structure 4 and the base structure 3 cannot move with respect to each other at the joint as a result of temperature changes.

The wall structure 4 of the filter chamber 1 in the electric filter according to the invention is, except for the rigid joint 6, provided to allow thermal expansion and contraction.

In FIG. 1, which shows the filter chamber of the electric filter according to the invention without thermal insulation, at least part of the wall structure 4 consists of verticals posts 7 between which wall elements 8 are attached.

The wall structure 4 of the filter chamber 1 in the electric filter shown in FIG. 1 comprises two side walls 9. FIG. 1 shows one of the side walls 9, the other one is on the other side of the electric filter. In FIG. 1 these side walls 9 consist of four vertical posts 7 between which three wall elements 8 are attached.

Figure 2:
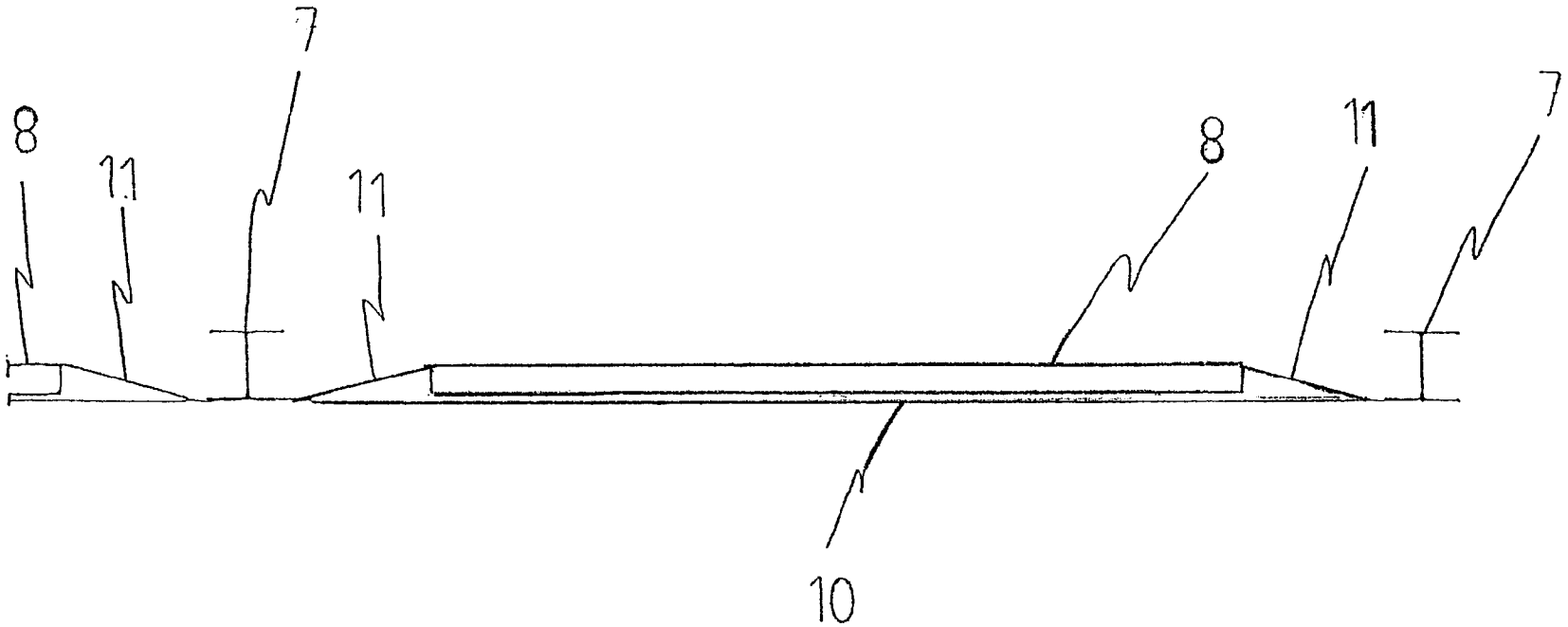
FIG. 2 is a cross-sectional view of the wall structure.

FIG. 2 illustrates part of the wall structure 4 which consists of vertical posts 7 between which wall elements 8 are attached. These vertical posts 7 are preferably attached to the base structure 3 with a substantially rigid joint 6. Here the rigid joint means that the vertical posts 7 are attached to the base structure 3 so that they cannot move with respect to the base structure 3 at the rigid joint 6. The lower ends of the vertical posts 7 can be e.g. welded onto masonry plates (not shown) embedded into the base structure 3.

In FIG. 2 the vertical posts 7 consist of I profiles but alternatively the vertical posts 7 may be mould from a profile with another kind of cross-sectional shape.

The wall elements 8 are preferably provided with stiffeners 10. In the figure these stiffeners 10 are made of U profiles, but alternatively the stiffeners 10 could be mould from a profile with another kind of cross-sectional shape. The purpose of these stiffeners 10 is to reinforce the wall elements 8 against the pressure in the filter chamber 1 of the electric filter.

As is seen e.g. from FIG. 2, the wall elements 8 are attached to the vertical posts 7 by two connecting plates 11. As FIG. 2 shows, one connecting plate 11 is attached to the first vertical post 7, and the other connecting plate 11 is attached to the second vertical post 7 next to the above-mentioned first vertical post. The wall element 8 is attached between the first connecting plate 11 and the second connecting plate 11.

The connecting plates 11 are preferably attached to the wall element 8 without seams, i.e. the connecting plates 11 and the wall element 8 are made of the same plate preform or the like.

As is shown in FIG. 2, the connecting plate 11 is preferably attached to form an angle with the wall element 8. By attaching the connecting plate 11 to the wall element 8 so that it forms an angle therewith, the thermal expansion and contraction can be controlled so that the vertical posts 7, which are preferably fixed to the base structure 3, do not move with respect to one another as the wall elements 8 and connecting plates 11 widen and narrow due to temperature changes. In other words, the wall elements 8 and connecting plates 11 can expand and contract without affecting the distance between the vertical posts 7.

As the wall element 8 and the connecting plate 11 widen due to the heat, in the structure according to FIG. 2 the wall element 8, which becomes longer, moves slightly inside the filter chamber 1 of the electric filter (upwards in FIG. 2) because the connecting plate 11 also widens. Correspondingly, when the wall element 8 and the connecting plate 11 narrow as they cool down, the wall element 8 moves slightly outwards (downwards in FIG. 2) because the connecting plate 11 narrows. For this reason, the distance between the vertical posts 7 remains substantially unchanged in both cases.

The wall element 8 can be alternatively attached so that it moves outwards from the electric filter as the electric filter heats up and inwards as the electric filter cools down.

Figure 4:
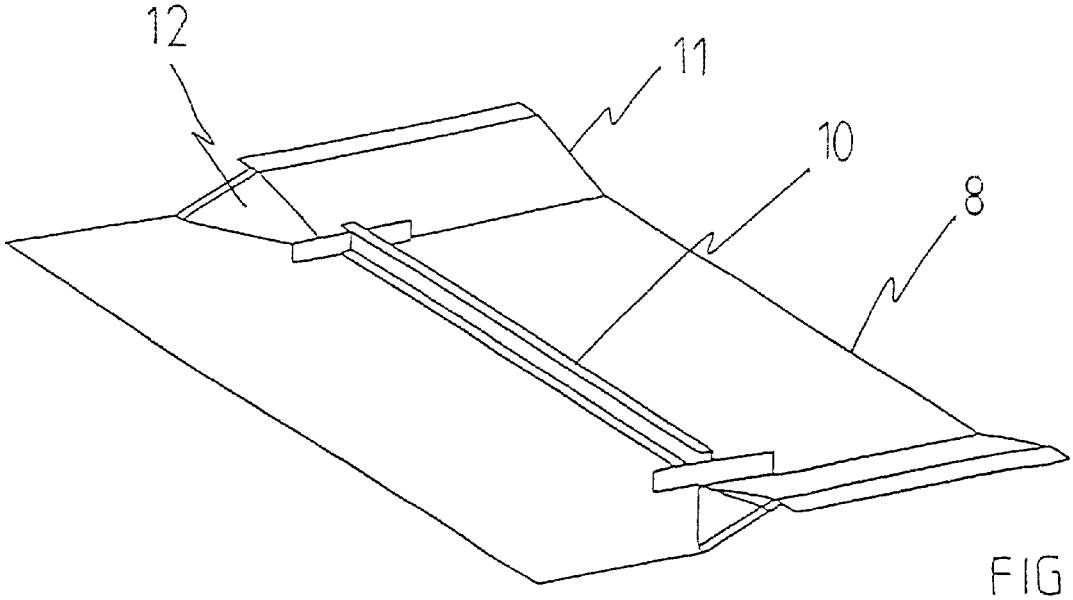
FIG. 4 illustrates the lower part of the wall element.
Figure 5:
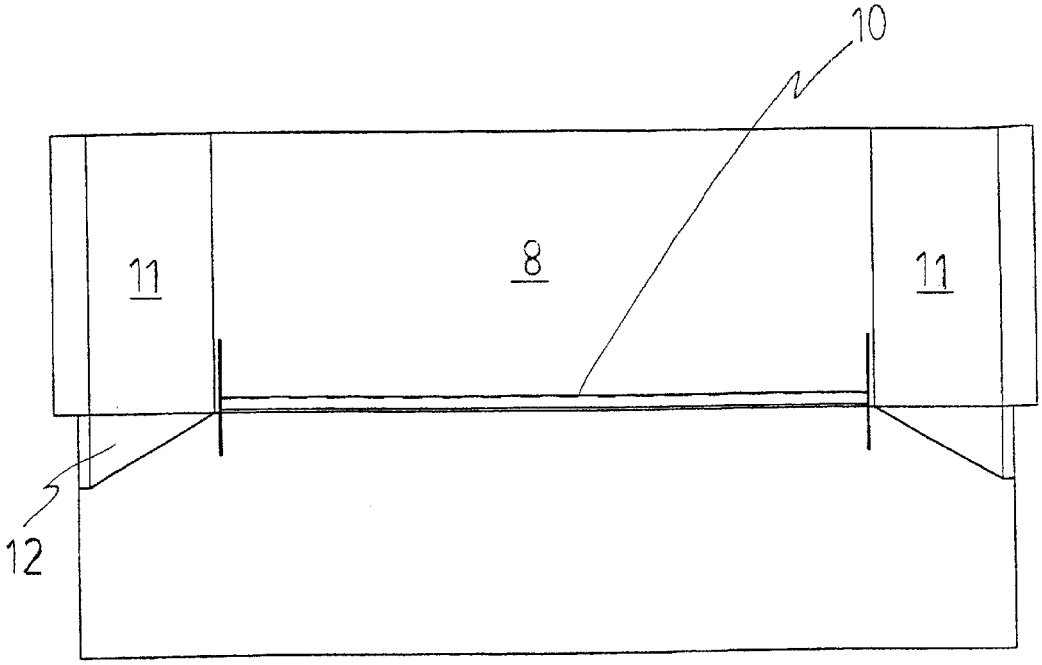
FIG. 5 is a side view of the lower part of the wall element shown in FIG. 4.
Figure 6:
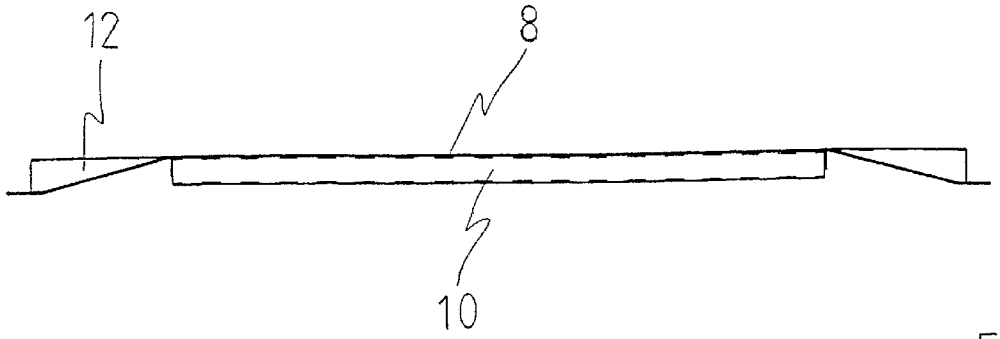
FIG. 6 is a bottom view of the lower part of the wall element shown in FIG. 4.

FIGS. 4 to 6 illustrate a solution in which the lower end 12 of the connecting plate 11 is bent. The purpose of this is to reinforce the filter chamber 1 of the electric filter against possible overpressure.

Figure 3:
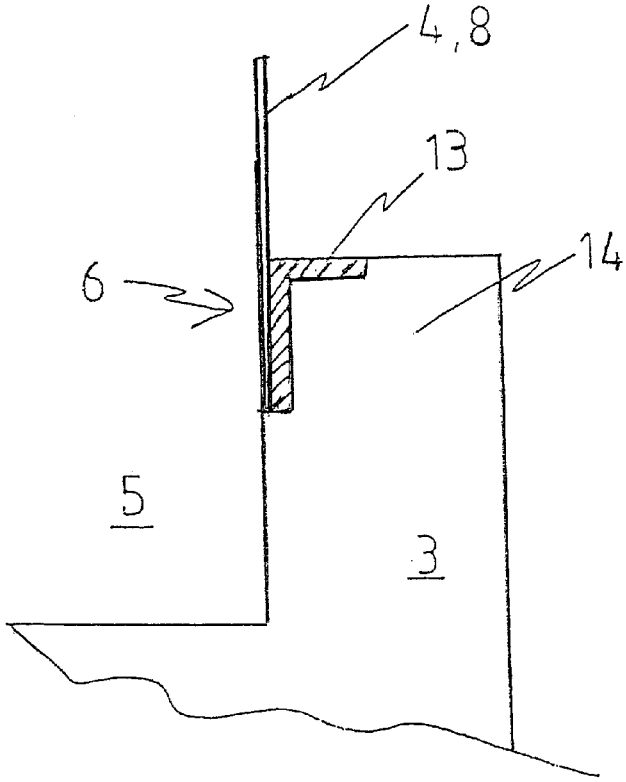
FIG. 3 is a detailed view of the joint between the wall structure and the base structure.

FIG. 3 is a cross-sectional view of the joint between the inner wall structure 4 and the base structure 3. In structure illustrated in FIG. 3 a profile 13 is attached to the base structure 3 and the lower edge of the wall element 8 is welded onto this profile 13, i.e. fixed to the profile. Alternatively, the wall element 8 may be attached to the base structure 3 using another joining method.

The profile 13 is provided with concrete anchors which are e.g. welded onto the profile and by means of which the profile is fastened to the base structure 3.

In FIG. 3 the profile 13 consists of an L profile, but alternatively the profile could be mould of a profile with another kind of cross-sectional shape. In FIG. 3 the profile 13 is also preferably embedded into the base structure 3 and placed so that it forms the upper edge pointing inside the filter chamber 1.

It will be obvious to a person skilled in the art that as the technology advances, the inventive concept can be implemented in various ways. Thus the invention and its embodiments are not limited to the examples described above, but may vary within the scope of the claims.

What is claimed is:

1. An electric filter, which comprises emission and separation systems, which are intended for separating particles from a gaseous, particle-containing medium passing through the electric filter, and a filter chamber which surrounds the emission and separation systems and their peripheral devices, the filter chamber comprising a top structure, a base structure, and a wall structure provided with thermal insulation and sheet metal cladding;

wherein the base structure is made of concrete and comprises at least one trough or hopper bottomed tank for separated particles, wherein the wall structure is made of steel and attached to the base structure with a substantially rigid joint, and wherein the wall structure, except for the rigid joint, is provided to allow thermal expansion and contraction.

2. An electric filter as claimed in claim 1, wherein the wall structure at least in part consists of vertical posts between which wall elements are attached.

3. An electric filter as claimed in claim 1 where the wall structure comprises two side walls, wherein the wall structure of side walls consists of vertical posts between which wall elements are attached.

4. An electric filter as claimed in claim 2, wherein that the vertical posts are attached to the base structure with a substantially rigid joint.

5. An electric filter as claimed in claim 2, wherein the wall elements are attached to the vertical posts by means of at least one connecting plate, and the connecting plate is attached between the wall element and the vertical post.

6. An electric filter as claimed in claim 5, wherein the connecting plate is attached to form an angle with the wall element.

7. An electric filter as claimed in claim 5, wherein the connecting plate is attached to the wall element without seams.

8. An electric filter as claimed in claim 2, wherein the wall element is attached to the base structure.

9. An electric filter as claimed in claim 8, wherein a profile is attached to the base structure, and the wall element is attached to the profile.

10. An electric filter as claimed in claim 5, wherein the lower edges of the connecting plates are bent.

* * * * *